US011156932B2

(12) United States Patent
Honda et al.

(10) Patent No.: US 11,156,932 B2
(45) **Date of Patent: *Oct. 26, 2021**

(54) TONER BINDER AND TONER

(71) Applicant: SANYO CHEMICAL INDUSTRIES, LTD., Kyoto (JP)

(72) Inventors: Masaru Honda, Kyoto (JP); Tomohisa Kato, Kyoto (JP); Yasuhiro Ono, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/761,987

(22) PCT Filed: Nov. 6, 2018

(86) PCT No.: PCT/JP2018/041207

§ 371 (c)(1),
(2) Date: May 6, 2020

(87) PCT Pub. No.: WO2019/107088

PCT Pub. Date: Jun. 6, 2019

(65) Prior Publication Data

US 2020/0264528 A1 Aug. 20, 2020

(30) Foreign Application Priority Data

Dec. 1, 2017 (JP) ..... JP2017-231782

(51) Int. Cl.
*G03G 9/08* (2006.01)
*G03G 9/087* (2006.01)

(52) U.S. Cl.
CPC ..... *G03G 9/08755* (2013.01); *G03G 9/08711* (2013.01); *G03G 9/08724* (2013.01); *G03G 9/08731* (2013.01); *G03G 9/08797* (2013.01)

(58) Field of Classification Search
CPC ..... G03G 9/08755; G03G 9/08711; G03G 9/08724; G03G 9/08797
USPC ..... 430/109.3, 109.4
See application file for complete search history.

(56) References Cited

U.S. PATENT DOCUMENTS

| | | | |
|---|---|---|---|
| 2010/0159385 | A1 | 6/2010 | Yang |
| 2010/0291481 | A1 | 11/2010 | Yamada et al. |
| 2011/0020741 | A1 | 1/2011 | Mizumori et al. |
| 2012/0052434 | A1 | 3/2012 | Sugimoto et al. |

FOREIGN PATENT DOCUMENTS

| | | |
|---|---|---|
| EP | 2 258 748 | 12/2010 |
| JP | 05-224463 | 9/1993 |
| JP | 2000-29246 | 1/2000 |
| JP | 2000-075549 | 3/2000 |
| JP | 2000-250264 | 9/2000 |
| JP | 2001-249492 | 9/2001 |
| JP | 2002-131979 | 5/2002 |
| JP | 2003-280245 | 10/2003 |
| JP | 2004-212739 | 7/2004 |
| JP | 2005-326842 | 11/2005 |
| JP | 2007-193069 | 8/2007 |
| JP | 2007-293323 | 11/2007 |
| JP | 2008-089829 | 4/2008 |
| JP | 2008-191491 | 8/2008 |
| JP | 2008-287229 | 11/2008 |
| JP | 2009-052005 | 3/2009 |
| JP | 2012-31270 | 2/2012 |
| JP | 2012-150467 | 8/2012 |
| JP | 2015-132645 | 7/2015 |
| JP | 2016-090750 | 5/2016 |
| JP | 2017-003985 | 1/2017 |
| JP | 2017-058587 | 3/2017 |
| JP | 2018-156074 | 10/2018 |
| WO | 2009/119055 | 10/2009 |

OTHER PUBLICATIONS

International Search Report dated Dec. 18, 2018 in International (PCT) Patent Application No. PCT/JP2018/041207.
International Search Report dated Nov. 20, 2018, in International (PCT) Application No. PCT/JP2018/033420.

*Primary Examiner* — Mark A Chapman
(74) *Attorney, Agent, or Firm* — Wenderoth, Lind & Ponack, L.L.P.

(57) ABSTRACT

The present invention relates to a toner binder containing: a polyester resin (A); and a vinyl resin (B), wherein the polyester resin (A) has an acid value of 2 mg KOH/g or more, the vinyl resin (B) has a weight average molecular weight of 4,000 to 40,000, the vinyl resin (B) is a polymer essentially containing a monomer (m) whose homopolymer has an SP value of 11.5 to 16.5 as a constituent monomer, the weight percentage of the monomer (m) in monomers constituting the vinyl resin (B) is 1 wt % or more based on the total weight of the monomers constituting the vinyl resin (B), the polyester resin (A) and the vinyl resin (B) are present at a weight ratio (A)/(B) of 80/20 to 99.5/0.5, and when the vinyl resin (B) contains polyethylene units (C11) having a degree of polymerization of 70 to 210 and/or polypropylene units (C12) having a degree of polymerization of 70 to 210, the total weight percentage of the polyethylene units (C11) and the polypropylene units (C12) in the vinyl resin (B) is 9 wt % or less based on the weight of the vinyl resin (B).

8 Claims, No Drawings

TONER BINDER AND TONER

TECHNICAL FIELD

The present invention relates to a toner binder and a toner.

BACKGROUND ART

Recent advancement in electrophotographic systems has brought a rapid increase in the demand for electrophotographic devices such as copy machines and laser printers and has also created the need for higher performance of these devices.

According to conventionally known methods and devices for full color electrophotographic images, an image is obtained by forming a latent image based on color image information on a latent image carrier such as an electrophotographic photoreceptor; forming a toner image using color toners corresponding to the colors of the latent image; and transferring the toner image to a transfer material. This image formation process is performed repeatedly. Then, the toner image on the transfer material is thermally fixed to produce a multicolor image.

For these processes to run smoothly, it is firstly required that the toner maintains a stable electrostatic charge level, and it is secondly required that the toner has good fixability to paper. In addition, the devices include heating elements in their fixing sections, and these heating elements raise the temperature in the devices. Thus, it is also required that the toner does not undergo blocking in the devices.

It is also required that a toner binder has grindability in order to improve the productivity of the toner and to obtain smaller toner particles. The productivity of the toner is directly connected to the production cost, and smaller toner particles are related to higher image quality.

Grindability is considered to have a conflicting relationship with hot offset resistance. A wide fixing temperature range is required to stabilize the fixing process. While the hot offset resistance is improved by a known technique such as increasing the molecular weight of a toner binder, introducing a cross-linked structure, or introducing a gel component, these techniques significantly reduce the grindability, and also reduce the productivity.

In order to improve the grindability without reducing the hot offset resistance, some suggested techniques include use of a graft polymer as an additive in which a vinyl monomer is grafted to low molecular weight polyethylene or low molecular weight polypropylene (Patent Literatures 1 and 2). Yet, the grindability effect is insufficient.

Other known techniques include a production method that includes adding external additives such as a fluidizer to toner that has been coarsely ground, and further finely grinding the toner (Patent Literatures 3 to 5). In this method, external additives are required in an amount more than necessary, and the external additives may be mixed into the toner, impairing fixing performance.

Various other grinding aids are suggested in Patent Literature 6 to 9 listed below. Yet, because of their compositions and/or physical properties, these grinding aids impair fixing performance, storage stability, and/or electrostatic charging properties in some way, and/or these grinding aids have insufficient grindability.

As described above, none of the conventional techniques provide excellent toner binders and toners which achieve improved grindability while maintaining low-temperature fixability, hot offset resistance, storage stability, and electrostatic charging properties.

CITATION LIST

Patent Literatures

Patent Literature 1: JP 2000-075549 A
Patent Literature 2: JP 2007-293323 A
Patent Literature 3: JP 2002-131979 A
Patent Literature 4: JP 2005-326842 A
Patent Literature 5: JP 2017-058587 A
Patent Literature 6: JP H05-224463 A
Patent Literature 7: JP 2008-089829 A
Patent Literature 8: JP 2008-191491 A
Patent Literature 9: JP 2015-132645 A

SUMMARY OF INVENTION

Technical Problem

The present invention aims to provide a toner excellent in low-temperature fixability, hot offset resistance, storage stability, electrostatic charging properties, and grindability, and a toner binder for use in the toner.

Solution to Problem

The present inventors extensively studied to solve above problems, and completed the present invention. The present invention relates to a toner binder containing: a polyester resin (A); and a vinyl resin (B), wherein the polyester resin (A) has an acid value of 2 mg KOH/g or more, the vinyl resin (B) has a weight average molecular weight of 4,000 to 40,000, the vinyl resin (B) is a polymer essentially containing a monomer (m) whose homopolymer has an SP value of 11.5 to 16.5 as a constituent monomer, the weight percentage of the monomer (m) in monomers constituting the vinyl resin (B) is 1 wt % or more based on the total weight of the monomers constituting the vinyl resin (B), the polyester resin (A) and the vinyl resin (B) are present at a weight ratio (A)/(B) of 80/20 to 99.5/0.5, and when the vinyl resin (B) contains polyethylene units (C11) having a degree of polymerization of 70 to 210 and/or polypropylene units (C12) having a degree of polymerization of 70 to 210, the total weight percentage of the polyethylene units (C11) and the polypropylene units (C12) in the vinyl resin (B) is 9 wt % or less based on the weight of the vinyl resin (B). The present invention also relates to a toner containing the toner binder and a colorant.

Advantageous Effects of Invention

The present invention can provide a toner and a toner binder having excellent productivity, wherein the toner and the toner binder are excellent in low-temperature fixability, hot offset resistance, storage stability, and electrostatic charging properties, and the toner binder has improved grindability.

DESCRIPTION OF EMBODIMENTS

The toner binder of the present invention is a toner binder containing: a polyester resin (A); and a vinyl resin (B), wherein the polyester resin (A) has an acid value of 2 mg KOH/g or more, the vinyl resin (B) has a weight average molecular weight of 4,000 to 40,000, the vinyl resin (B) is a polymer essentially containing a monomer (m) whose homopolymer has an SP value of 11.5 to 16.5 as a constituent monomer, the weight percentage of the monomer (m) in monomers constituting the vinyl resin (B) is 1 wt % or more based on the total weight of the monomers constituting the vinyl resin (B), the polyester resin (A) and the vinyl resin (B) are present at a weight ratio (A)/(B) of 80/20 to 99.5/0.5, and when the vinyl resin (B) contains polyethylene units (C11) having a degree of polymerization of 70 to 210 and/or polypropylene units (C12) having a degree of polymerization of 70 to 210, the total weight percentage of the polyethylene units (C11) and the polypropylene units (C12) in the vinyl resin (B) is 9 wt % or less based on the weight of the vinyl resin (B). The following sequentially describes the toner binder of the present invention.

The polyester resin (A) in the present invention contains a polyester resin obtained by polycondensation of at least one alcohol component (x) and at least one carboxylic acid component (y). The polyester resin is preferably an amorphous polyester resin in view of grindability of the toner binder. Examples of the alcohol component (x) include a diol (x1) and/or a tri- or higher polyol (x2). Examples of the carboxylic acid component (y) include a dicarboxylic acid (y1) and/or a tri- or higher polycarboxylic acid (y2). The carboxylic acid component (y) may be a monocarboxylic acid (y3), if necessary.

Examples of the diol (x1) include: C2-C36 alkylene glycols (e.g., ethylene glycol, 1,2-propylene glycol, 1,3-propylene glycol, 1,4-butanediol, and 1,6-hexanediol); C4-C36 alkylene ether glycols (e.g., diethylene glycol, triethylene glycol, dipropylene glycol, polyethylene glycol, polypropylene glycol, and polytetramethylene ether glycol); C6-C36 alicyclic diols (e.g., 1,4-cyclohexane dimethanol and hydrogenated bisphenol A); adducts (preferably, the average number of moles added is 1 to 30) of alkylene oxide with the alicyclic diols; and adducts (preferably, the average number of moles added is 2 to 30) of alkylene oxide with dihydric phenols (e.g., monocyclic dihydric phenols (such as hydroquinone) and bisphenols (e.g., bisphenol A, bisphenol F, and bisphenol S)). The alkylene oxide (hereinafter the "alkylene oxide" is sometimes abbreviated as "AO") preferably has a C2-C4 alkylene group. Preferred alkylene oxides include ethylene oxide, 1,2- or 1,3-propylene oxide, 1,2-, 2,3-, 1,3- or iso-butylene oxide, and tetrahydrofuran. Ethylene oxide and 1,2- or 1,3-propylene oxide are more preferred.

In view of low-temperature fixability and storage stability of the toner binder and the toner, preferred among these are adducts (preferably, the average number of moles added is 2 to 30) of alkylene oxide with bisphenols and C2-C12 alkylene glycols. More preferred are adducts (still more preferably, the average number of moles added is 2 to 8) of alkylene oxide with bisphenols (still more preferably bisphenol A) and C2-C12 alkylene glycols (still more preferred are ethylene glycol and 1,2-propylene glycol, particularly preferred is 1,2-propylene glycol).

Examples of the tri- or higher polyol (x2) include: C3-C36 tri- or higher aliphatic polyols (x21); saccharides and derivatives thereof (x22); adducts (preferably, the average number of moles added is 1 to 30) of AO with aliphatic polyols (x23); adducts (preferably, the average number of moles added is 2 to 30) of AO with trisphenols (e.g., trisphenol PA) (x24); and adducts (preferably, the average number of moles added is 2 to 30) of AO with novolac resins (including phenol novolac and cresol novolac; preferably, the degree of polymerization is 3 to 60) (x25).

Examples of the C3-C36 tri- or higher aliphatic polyol (x21) include alkane polyols and intramolecular or intermolecular dehydrated products thereof. Examples thereof include glycerol, trimethylolethane, trimethylolpropane, pentaerythritol, sorbitol, sorbitan, polyglycerol, and dipentaerythritol.

Examples of the saccharide and the derivative thereof (x22) include sucrose and methylglucoside.

Preferred among these in view of low-temperature fixability and hot offset resistance of the toner binder and the toner containing the toner binder are adducts (preferably, the average number of moles added is 2 to 30) of AO with novolak resin and tri- or higher aliphatic polyols. Particularly preferred are adducts (preferably, the average number of moles added is 2 to 30) of AO with novolac resin (including phenol novolac and cresol novolac; preferably, the average degree of polymerization is 3 to 60), glycerol, and trimethylolpropane.

Examples of the dicarboxylic acid (y1) include C4-C36 alkane dicarboxylic acids (such as succinic acid, adipic acid, and sebacic acid), alkenyl succinic acids (such as dodecenyl succinic acid), C6-C40 alicyclic dicarboxylic acids (such as dimer acids (e.g., dimerized linoleic acid)), C4-C36 alkene dicarboxylic acids (such as maleic acid, fumaric acid, citraconic acid, and mesaconic acid), and C8-C36 aromatic dicarboxylic acids (such as phthalic acid, isophthalic acid, terephthalic acid, and naphthalene dicarboxylic acid).

The dicarboxylic acid (y1) may be an anhydride or lower alkyl (C1-C4) ester (e.g., methyl ester, ethyl ester, or isopropyl ester) of these carboxylic acids. Such an anhydride or lower alkyl ester may be used in combination with any of the carboxylic acids.

In view of low-temperature fixability and storage stability, preferred among these are C4-C36 alkane dicarboxylic acids, C4-C20 alkene dicarboxylic acids, and C8-C20 aromatic dicarboxylic acids. More preferred are adipic acid, fumaric acid, and terephthalic acid. The dicarboxylic acid (y1) may also be an anhydride or lower alkyl ester of these acids.

Examples of the tri- or higher polycarboxylic acid (y2) include C6-C36 aliphatic tricarboxylic acids (e.g., hexanetricarboxylic acid) and C9-C20 aromatic polycarboxylic acids (e.g., trimellitic acid and pyromellitic acid).

The tri- or higher polycarboxylic acid (y2) may be an anhydride or lower alkyl (C1-C4) ester (e.g., methyl ester, ethyl ester, or isopropyl ester) of these carboxylic acids. Such an anhydride or lower alkyl ester may be used in combination with any of the carboxylic acids.

In view of hot offset resistance and electrostatic charging properties of the toner binder and the toner, preferred among these are trimellitic acid, pyromellitic acid, and anhydrides and lower alkyl (C1-C4) esters of these carboxylic acids.

Examples of the monocarboxylic acid (y3) include aliphatic monocarboxylic acids and aromatic monocarboxylic acids. Specific examples include C2-C50 aliphatic monocarboxylic acids (e.g., acetic acid, propionic acid, butyric acid, valeric acid, caproic acid, enanthic acid, caprylic acid, pelargonic acid, capric acid, lauric acid, myristic acid, palmitic acid, margaric acid, stearic acid, and behenic acid) and C7-C37 aromatic monocarboxylic acids (e.g., benzoic acid, toluic acid, 4-ethylbenzoic acid, and 4-propylbenzoic acid).

In view of storage stability, preferred among these is benzoic acid.

The polyester resin (A) in the present invention can be produced in the same manner as conventional polyester production methods. For example, the polyester resin (A)

can be produced by a reaction of components including the alcohol component (x) and the carboxylic acid component (y) under an inert gas (e.g., nitrogen gas) atmosphere, preferably at a reaction temperature of 150° C. to 280° C., more preferably 160° C. to 250° C., still more preferably 170° C. to 235° C. In order to complete the polycondensation reaction, the reaction time is preferably 30 minutes or longer, more preferably 2 to 40 hours.

At this time, an esterification catalyst can also be used, if necessary.

Examples of the esterification catalyst include tin-containing catalysts (e.g., dibutyl tin oxide), antimony trioxide, titanium-containing catalysts, zirconium-containing catalysts (e.g., zirconium acetate), and zinc acetate. Examples of the titanium-containing catalysts include titanium alkoxide, potassium oxalate titanate, titanium terephthalate, titanium terephthalate alkoxide, catalysts described in JP 2006-243715 A (e.g., titanium diisopropoxy bis(triethanol aminate), titanium dihydroxy bis(triethanolaminate), titanium monohydroxy tris(triethanolaminate), titanyl bis(triethanolaminate), and intramolecular polycondensation products thereof), and catalysts described in JP 2007-11307 A (e.g., titanium tributoxy terephthalate, titanium triisopropoxy terephthalate, and titanium diisopropoxy diterephthalate). Preferred among these are titanium-containing catalysts. It is also effective to reduce pressure in order to increase the rate of reaction in the last stage of the reaction.

In addition, a stabilizer may be added in order to stabilize the polyester polymerization. Examples of the stabilizer include hydroquinone, methyl hydroquinone, and hindered phenolic compounds.

The reaction ratio of the alcohol component (x) to the carboxylic acid component (y) in terms of equivalent ratio of hydroxyl groups to carboxyl groups [OH]/[COOH] is preferably 2/1 to 1/2, still more preferably 1.5/1 to 1/1.3, particularly preferably 1.3/1 to 1/1.2. The hydroxyl group is derived from the alcohol component (x).

The polyester resin (A) used in the present invention includes a linear polyester resin (A1) and a non-linear polyester (branched or crosslinked polyester) resin (A2). These polyester resins may be each used alone, or each of polyester resins may be a combination of two or more kinds. Alternatively, a mixture of the linear polyester resin (A1) and the non-linear polyester resin (A2) may be used. In view of the balance between low-temperature fixability and hot offset resistance, the polyester resin (A) is preferably a mixture of the linear polyester resin (A1) and the non-linear polyester resin (A2). In view of the balance between low-temperature fixability and hot offset resistance, the linear polyester resin (A1) and the non-linear polyester resin (A2) are preferably present at a weight ratio (A1)/(A2) of 10/90 to 90/10, more preferably 15/85 to 85/15, still more preferably 20/80 to 80/20, particularly preferably 30/70 to 70/30.

The linear polyester resin (A1) is obtained by polycondensation of the diol (x1) and the dicarboxylic acid (y1). The linear polyester resin (A1) may also be one that is modified at a molecular end thereof by an anhydride of the carboxylic acid component (y) (which may be a tri- or higher polycarboxylic acid).

The non-linear polyester resin (A2) is obtained by a reaction of the dicarboxylic acid (y1) and the diol (x1) with the tri- or higher polycarboxylic acid (y2) and/or the tri- or higher polyol (x2). In view of low-temperature fixability and hot offset resistance, the ratio of the total moles of the tri- or higher polycarboxylic acid (y2) and the tri- or higher polyol (x2) to the total moles of the alcohol component (x) and the carboxylic acid component (y) [((y2)+(x2))/((x)+(y))] to obtain the non-linear polyester resin (A2) is preferably 0.1 to 40 mol %, more preferably 1 to 30 mol %, still more preferably 2 to 25 mol %, particularly preferably 3 to 20 mol %.

In view of low-temperature fixability and storage stability, the glass transition temperature of the linear polyester resin (A1) is preferably 40° C. to 75° C., more preferably 45° C. to 70° C., still more preferably 47° C. to 67° C., particularly preferably 50° C. to 65° C.

The glass transition temperature can be measured by, for example, the method (DSC method) prescribed in ASTM D3418-82 using a differential scanning calorimeter.

In view of low-temperature fixability and storage stability, the weight average molecular weight of the tetrahydrofuran (hereinafter abbreviated as "THF")-soluble content of the linear polyester resin (A1) is preferably 4,000 to 10,000, more preferably 4,500 to 8,000, still more preferably 5,000 to 7,000.

The weight average molecular weight (hereinafter sometimes abbreviated as "Mw") of each of the polyester resin (A), the vinyl resin (B), and a crystalline resin (E) (described later) can be determined by gel permeation chromatography (hereinafter abbreviated as "GPC") under the following conditions.

Device (an example): HLC-8120 (Tosoh Corporation)
Column (an example): TSK GEL GMH6, two columns (Tosoh Corporation)
Measurement temperature: 40° C.
Sample solution: 0.25 wt % solution in THF
Amount of solution to be injected: 100 μL
Detection device: refractive index detector
Standard substance: standard polystyrene available from Tosoh Corporation (TSK standard polystyrene), 12 samples (molecular weight: 500, 1,050, 2,800, 5,970, 9,100, 18,100, 37,900, 96,400, 190,000, 355,000, 1,090,000, and 2,890,000)

For measurement, each sample is dissolved in THF to a concentration of 0.25 wt %, and the insoluble content is filtered by a glass filter to obtain a sample solution.

In view of low-temperature fixability, the amount of the THF-insoluble content of the linear polyester resin (A1) is preferably 3 wt % or less, more preferably 1 wt % or less, still more preferably 0 wt %.

In view of low-temperature fixability, storage stability, and electrostatic charge stability, the acid value (mg KOH/g) of the linear polyester resin (A1) is preferably 3 to 35, more preferably 4 to 30, still more preferably 5 to 28, particularly preferably 7 to 25. In the present invention, the acid value is a value measured by the method prescribed in JIS K 0070 (1992 edition).

In view of low-temperature fixability and storage stability, the hydroxyl value (mg KOH/g) of the linear polyester resin (A1) is preferably 20 to 80, more preferably 25 to 75, still more preferably 30 to 70, particularly preferably 35 to 65.

In the present invention, the hydroxyl value is a value measured by the method prescribed in JIS K 0070 (1992 edition).

In view of low-temperature fixability and storage stability, the glass transition temperature of the non-linear polyester resin (A2) is preferably 40° C. to 75° C., more preferably 45° C. to 70° C., still more preferably 47° C. to 67° C., particularly preferably 50° C. to 65° C.

In view of low-temperature fixability and hot offset resistance, the weight average molecular weight of the THF-soluble content of the non-linear polyester resin (A2) is preferably 8,000 or more, more preferably 10,000 or more, still more preferably 13,000 to 1,000,000.

In view of low-temperature fixability and hot offset resistance, the amount of the THF-insoluble content of the non-linear polyester resin (A2) is preferably 1 wt % or more, more preferably 3 wt % or more, still more preferably 5 wt % or more, particularly preferably 10 wt % to 50 wt %.

In view of electrostatic charge stability and productivity of the toner, the acid value (mg KOH/g) of the non-linear polyester resin (A2) is preferably 2 to 35, more preferably 2 to 30, still more preferably 2 to 28, particularly preferably 2 to 25.

In view of hot offset resistance and productivity, the hydroxyl value (mg KOH/g) of the non-linear polyester resin (A2) is preferably 1 to 50, more preferably 1 to 45, still more preferably 1 to 40, particularly preferably 1 to 35.

In view of low-temperature fixability and electrostatic charge stability, the acid value of the polyester resin (A) is 2 mg KOH/g or more. When the acid value of the polyester resin (A) is less than 2 mg KOH/g, the resulting product has poor low-temperature fixability and poor electrostatic charge stability. The acid value of the polyester resin (A) is preferably 2 to 35 mg KOH/g, more preferably 3 to 30 mg KOH/g, still more preferably 4 to 28 mg KOH/g, particularly preferably 5 to 25 mg KOH/g.

The types and weight ratio of the linear polyester resin (A1) and the non-linear polyester resin (A2) may be adjusted such that the polyester resin (A) has an acid value in the above range.

In view of heat-resistant storage stability and low-temperature fixability, the glass transition temperature of the polyester resin (A) is preferably 40° C. to 75° C., more preferably 45° C. to 70° C., still more preferably 47° C. to 67° C., particularly preferably 50° C. to 65° C.

In view of low-temperature fixability and hot offset resistance, the amount of the THF-insoluble content of the polyester resin (A) is preferably 1 wt % or more, more preferably 2 wt % or more, still more preferably 2 to 50 wt %.

The types and weight ratio of the linear polyester resin (A1) and the non-linear polyester resin (A2) are preferably adjusted such that the glass transition temperature of the polyester resin (A) and the amount of the THF-insoluble content are in the above ranges.

In view of storage stability, low-temperature fixability, and grindability, the vinyl resin (B) has a weight average molecular weight of 4,000 to 40,000, preferably 4,000 to 20,000, more preferably 4,500 to 15,000, still more preferably 4,500 to 10,000, particularly preferably 5,000 to 8,000.

In view of storage stability and dispersibility of the vinyl resin (B), the vinyl resin (B) preferably has a solubility parameter (hereinafter abbreviated as "SP value") ($(cal/cm^3)^{1/2}$, the unit is the same for the following SP value) of 10.0 to 12.6, more preferably 10.6 to 11.8, still more preferably 10.6 to 11.7, particularly preferably 10.7 to 11.6, most preferably 10.8 to 11.5. When the SP value is 12.6 or less and 10.0 or more, the difference in the SP value between the vinyl resin (B) and the polyester resin (A) is moderate, achieving good dispersibility of the vinyl resin (B) in the polyester resin (A).

In view of storage stability and dispersibility of the vinyl resin (B), the SP value of the polyester resin (A) is preferably 10.5 to 12.5, more preferably 10.7 to 12.3, still more preferably 10.8 to 12.0, particularly preferably 10.9 to 11.9. When the SP value is 12.5 or less and 10.5 or more, the difference in the SP value between the polyester resin (A) and the vinyl resin (B) is moderate, achieving better dispersibility of the vinyl resin (B) in the polyester resin (A).

The SP value in the present invention is calculated by the method disclosed by Robert F. Fedors et al. (Polymer engineering and science, February, 1974, Vol. 14, No. 2, pp. 147-154).

The vinyl resin (B) is a polymer essentially containing a monomer (m) whose homopolymer has an SP value of 11.5 to 16.5 as a constituent monomer. More preferably, the vinyl resin (B) is a copolymer containing the monomer (m) whose homopolymer has an SP value of 11.5 to 16.5 and a monomer (n) which is not a C2-C12 olefin (c) and whose homopolymer has an SP value of 8.0 to 11.5 as constituent monomers. The monomer (m) and the monomer (n) may be each used alone or each of these monomers may be a combination of two or more kinds.

Examples of the monomer (m) include an unsaturated nitrile monomer (m1) and an α,β-unsaturated carboxylic acid (m2).

Examples of the unsaturated nitrile monomer (m1) include monomers containing a vinyl group and a nitrile group, which have 3 to 20 carbon atoms. Specific examples include (meth)acrylonitrile (SP value of acrylonitrile: 14.4; SP value of methacrylonitrile: 12.7), cyano styrene (SP value: 13.1), and trimethylolpropane triacrylate (SP value: 11.9). Preferred among these is (meth)acrylonitrile.

In the present invention, the term "(meth)acrylo" refers to "acrylo" and/or "methacrylo".

Examples of the α,β-unsaturated carboxylic acid (m2) include those having 3 to 20 carbon atoms, such as unsaturated carboxylic acids and anhydrides thereof (e.g., (meth) acrylic acid (SP value of acrylic acid: 14.0; SP value of methacrylic acid: 12.5), maleic acid (SP value: 16.4), fumaric acid (SP value: 16.4), itaconic acid (SP value: 15.1), and anhydrides thereof), and unsaturated dicarboxylic acid monoesters (e.g., monomethyl maleate (SP value: 13.2) and itaconic acid monomethyl (SP value: 12.6)).

Preferred among these are (meth)acrylic acid and unsaturated dicarboxylic acid monoesters, and more preferred are (meth)acrylic acid and monomethyl maleate.

In the present invention, the term "(meth)acryl" refers to "acryl" and/or "methacryl".

Examples of the monomer (n) include styrene monomers such as styrene (SP value: 10.6), α-methylstyrene (SP value: 10.1), p-methylstyrene (SP value: 10.1), m-methylstyrene (SP value: 10.1), p-methoxystyrene (SP value: 10.5), p-acetoxystyrene (SP value: 11.3), vinyltoluene (SP value: 10.3), ethylstyrene (SP value: 10.1), phenylstyrene (SP value: 11.1), and benzylstyrene (SP value: 10.9); alkyl (preferably C1-C18) unsaturated carboxylates such as alkyl (meth) acrylates (e.g., methyl (meth)acrylate (SP value of methyl acrylate: 10.6; SP value of methyl methacrylate: 9.9), ethyl (meth)acrylate (SP value of ethyl acrylate: 10.2; SP value of ethyl methacrylate: 10.0), butyl (meth)acrylate (SP value of butyl acrylate: 9.8; SP value of butyl methacrylate: 9.4), 2-ethylhexyl (meth)acrylate (SP value of 2-ethylhexyl acrylate: 9.2; SP value of 2-ethylhexyl methacrylate: 9.0), and stearyl (meth)acrylate (SP value of stearyl acrylate: 9.0; SP value of stearyl methacrylate: 8.9)); vinyl ester monomers such as vinyl acetate (SP value: 10.6); halogen-containing vinyl monomers (such as vinyl chloride (SP value: 11.0); and combinations thereof.

Preferred among these are styrene monomers, alkyl unsaturated carboxylates, and halogen-containing vinyl monomer, more preferred are styrene monomers and alkyl unsaturated carboxylates, and still more preferred are styrenes and combinations of styrenes and alkyl (meth) acrylates.

In view of storage stability and grindability, the weight percentage of the monomer (m) in the monomers constituting the vinyl resin (B) is 1 wt % or more, preferably 1 to 50 wt %, more preferably 1.5 to 40 wt %, still more preferably 1.5 to 30 wt %, particularly preferably 1.9 to 30 wt %, based on the total weight of the monomers constituting the vinyl resin (B).

The vinyl resin (B) may contain the C2-C12 olefin (c) as a constituent monomer. The olefin (c) is a C2-C12 olefin. Specific examples thereof include ethylene, propylene, 1-butene, isobutylene, 1-hexene, 1-dodecene, and 1-octadecene.

When the vinyl resin (B) contains the olefin (c) as a constituent monomer, the olefin (c) may constitute a polyolefin resin unit (C) contained in the vinyl resin (B). The polyolefin resin unit (C) is a polymer unit derived from a polyolefin resin. For example, the vinyl resin (B) may be a structure obtained by grafting a copolymer containing the monomer (m) and the monomer (n) to the polyolefin resin unit (C). Examples of the polyolefin resin of the polyolefin resin unit (C) include a polymer (C-1) of the olefin (c), an oxide (C-2) of a polymer of the olefin (c), and a modified product (C-3) of a polymer of the olefin (c).

Examples of the polymer (C-1) of the olefin (c) include polymers derived from C2-C12 olefins such as polyethylene, polypropylene, ethylene/propylene copolymers, ethylene/1-butene copolymers, and propylene/1-hexene copolymers. The unit of the polymer (C-1) of the olefin (c) may be reworded as a polyolefin unit or a polyolefin block. For example, the polyethylene unit may be reworded as a polyethylene block or an ethylene homopolymer part. The polypropylene unit may be reworded as a polypropylene block or a propylene homopolymer part.

Examples of the oxide (C-2) of a polymer of the olefin (c) include an oxide of the polymer (C-1) of the olefin (c). Examples thereof include oxidized polyethylene and oxidized polypropylene.

Examples of the modified polymer (C-3) of the olefin (c) include adducts of maleic acid derivatives (e.g., maleic anhydride, monomethyl maleate, monobutyl maleate, and dimethyl maleate) of the polymer (C-1) of the olefin (c), such as maleinized polypropylene.

The vinyl resin (B) containing the polyolefin resin unit (C) may be a vinyl resin obtained by reacting the monomer (m), the monomer (n), and the polyolefin resin, for example.

For example, when the polymer (C-1) of the olefin (c) is used as a polyolefin resin in the production of the vinyl resin (B), the resulting vinyl resin (B) contains a unit of the polymer (C-1) of the olefin (c).

In view of grindability of the toner binder, when the vinyl resin (B) contains polyethylene units and/or polypropylene units, the polyethylene units and the polypropylene units preferably have a degree of polymerization of less than 70. In view of grindability of the toner binder, when the vinyl resin (B) contains the polyethylene units (C11) having a degree of polymerization of 70 to 210 and/or the polypropylene units (C12) having a degree of polymerization of 70 to 210, the total weight percentage of the polyethylene units (C11) and the polypropylene units (C12) in the vinyl resin (B) is 9 wt % or less based on the weight of the vinyl resin (B). The total weight percentage of the polyethylene units (C11) having a degree of polymerization of 70 to 210 and the polypropylene units (C12) having a degree of polymerization of 70 to 210 in the vinyl resin (B) based on the weight of the vinyl resin (B) is preferably less than 9 wt %, more preferably 1 wt % or less, still more preferably 0.5 wt % or less, yet still more preferably 0.3 wt % or less, particularly preferably 0.1 wt % or less. In one embodiment, preferably, the vinyl resin (B) is free of the polyethylene units (C11) having a degree of polymerization of 70 to 210 and the polypropylene units (C12) having degree of polymerization of 70 to 210.

The total weight percentage of the polyethylene units (C11) and the polypropylene units (C12) in the vinyl resin (B) can also be regarded as the total weight percentage of ethylene constituting the polyethylene units (C11) and propylene constituting the polypropylene units (C12) based on the total weight of the monomers constituting the vinyl resin (B).

In one embodiment, preferably, the vinyl resin (B) is free of polyethylene units and polyethylene units. More preferably, the vinyl resin (B) is free of the polyolefin resin units (C) such as a polyethylene unit, a polypropylene unit, an ethylene/propylene polymer unit, an oxidized polyethylene unit, an oxidized polypropylene unit, and a maleinized polypropylene unit. Still more preferably, the vinyl resin (B) is free of units of the polymer (C-1) of the olefin (c), units of the oxide (C-2) of a polymer of the olefin (c), and units of the modified product (C-3) of a polymer of the olefin (c).

In one embodiment, in view of low-temperature fixability and grindability, the total weight percentage of ethylene and propylene in the monomers constituting the vinyl resin (B) is preferably 20 wt % or less, more preferably 15 wt % or less, still more preferably 10 wt % or less, based on the total weight of the monomers constituting the vinyl resin (B). The weight percentage of the olefin (c) in the monomers constituting the vinyl resin (B) is preferably 20 wt % or less, more preferably 15 wt % or less, still more preferably, 10 wt % or less, based on the total weight of the monomers constituting the vinyl resin (B). In one embodiment, the vinyl resin (B) is preferably free of ethylene and propylene in its constituent monomers, and may be free of the olefin (c). Preferably, the vinyl resin (B) is free of the polyolefin resin units (C).

According to an example of a method of producing the vinyl resin (B), the polyolefin resin (C) is melted, if necessary, in toluene or xylene heated to 100° C. to 200° C.; a vinyl monomer (a mixture of the monomer (m), monomer (n), and if necessary, the olefin (c) or the like) and a radical reaction initiator (d) are added dropwise to the toluene or xylene for polymerization; and a solvent is removed after the polymerization. The vinyl resin (B) is thus obtained.

Any radical reaction initiator (d) may be used. Examples thereof include an inorganic peroxide (d1), an organic peroxide (d2), and an azo compound (d3). These radical reaction initiators may be used in combination.

Any inorganic peroxide (d1) may be used. Examples thereof include hydrogen peroxide, ammonium persulfate, potassium persulfate, and sodium persulfate.

Non-limiting examples of the organic peroxide (d2) include benzoyl peroxide, di-t-butyl peroxide, t-butyl cumyl peroxide, dicumyl peroxide, α,α-bis(t-butylperoxy) diisopropylbenzene, 2,5-dimethyl-2,5-bis(t-butylperoxy) hexane, di-t-hexyl peroxide, 2,5-dimethyl-2,5-di-t-butylperoxyhexine-3, acetyl peroxide, isobutyryl peroxide, octanoyl peroxide, decanoyl peroxide, lauroyl peroxide, 3,3,5-trimethylhexanoyl peroxide, m-tolyl peroxide, t-butyl peroxyisobutyrate, t-butyl peroxyneodecanoate, cumyl peroxyneodecanoate, t-butyl peroxy-2-ethylhexanoate, t-butyl peroxy-3,5,5-trimethylhexanoate, t-butyl peroxylaurate, t-butyl peroxybenzoate, t-butyl peroxy isopropyl monocarbonate, and t-butyl peroxyacetate.

Non-limiting examples of the azo compound or diazo compound (d3) include 2,2'-azobis-(2,4-dimethylvaleronitrile), 2,2'-azobisisobutyronitrile, 1,1'-azobis(cyclohexane- 1-carbonitrile), 2,2'-azobis-4-methoxy-2,4-dimethylvaleronitrile, and azobisisobutyronitrile.

Preferred among these are the organic peroxides (d2) because they have high initiator efficiency and do not produce toxic by-products such as cyanide.

Further, particularly preferred among the organic peroxides (d2) are reaction initiators having a high hydrogen abstraction ability because such reaction initiators efficiently promote a crosslinking reaction and can be used in smaller amounts. Examples of such reaction initiators include benzoyl peroxide, di-t-butyl peroxide, t-butyl cumyl peroxide, dicumyl peroxide, α,α-bis(t-butylperoxy) diisopropylbenzene, 2,5-dimethyl-2,5-bis(t-butylperoxy)hexane, and di-t-hexyl peroxide.

The amount of the radical reaction initiator (d) used to synthesize the vinyl resin (B) is preferably 0.1 to 20 wt %, more preferably 0.15 to 15 wt %, still more preferably 0.2 to 10 wt %, particularly preferably 0.3 to 8 wt %, based on the weight of the vinyl resin (B) produced.

In view of storage stability, the polymerization rate of the vinyl resin (B) is preferably 98% or higher, more preferably 98.5% or higher, still more preferably 99% or higher, particularly preferably 99.5% or higher.

The polymerization rate of the vinyl resin (B) can be determined by the following method. The case where a styrene monomer is used is described as an example.

Device: GC-14A available from Shimadzu Corporation
Column: 20% PEG-20 M glass column (2 m) packed with chromosorb W (Phenomenex)
Internal standard: amyl alcohol
Detector: FID detector
Column temperature: 100° C.
Sample concentration: 5% solution in DMF Calibration curves of styrene and amyl alcohol are created in advance, and the amount of styrene monomer in the sample is determined based on the calibration curves. The polymerization rate is calculated from the amount of residual styrene monomer relative to the amount fed. The sample is dissolved in dimethylformamide (DMF) to a concentration of 5 wt %, followed by standing for 10 minutes. The supernatant is used as a sample solution.

In view of storage stability, the amount of residue of an organic solvent used in the synthesis of the vinyl resin (B) is preferably 1 wt % or less, more preferably 0.5 wt % or less, still more preferably 0.3 wt % or less, particularly preferably 0.2 wt % or less, based on the weight of the vinyl resin (B).

The toner binder in the present invention is obtained by, for example, adding the vinyl resin (B) to the polyester resin (A) through melt-kneading.

In the view of storage stability, electrostatic charging properties, and grindability of the toner and the toner binder, the number average dispersed particle size of the vinyl resin (B) in the toner binder is preferably 0.02 to 2 μm, more preferably 0.03 to 1.7 μm, still more preferably 0.05 to 1.5 μm, particularly preferably 0.07 to 1.3 μm, most preferably 0.1 to 1 μm. The number average dispersed particle size of the vinyl resin (B) can be measured by a method described in Examples.

The number average dispersed particle size of the vinyl resin (B) in the toner binder can be easily adjusted to the above range by adjusting the SP value of the polyester resin (A), the SP value of the vinyl resin (B), the acid value of the polyester resin (A), and the acid value of the vinyl resin (B).

In view of low-temperature fixability, hot offset resistance, and grindability, the weight ratio (A)/(B) of the polyester resin (A) to the vinyl resin (B) in the toner binder is 80/20 to 99.5/0.5, preferably 85/15 to 99/1, more preferably 90/10 to 98.5/1.5, still more preferably 93/7 to 98/2.

Preferably, the toner binder of the present invention satisfies the following relation (1):

$$0.1 \leq |SP(a)-SP(b)| \leq 1.4 \quad \text{relation (1):}$$

where SP(a) is the solubility parameter of the polyester resin (A), and SP(b) is the solubility parameter of the vinyl resin (B).

In view of fixability, storage stability, and grindability, the absolute value (|SP(a)−SP(b)|) of the difference between a solubility parameter (SP(a)) of the polyester resin (A) and a solubility parameter (SP(b)) of the vinyl resin (B) is preferably 0.1 to 1.4, more preferably 0.1 to 1.3, still more preferably 0.2 to 1.1, particularly preferably 0.2 to 1.0. When the relation (1) is satisfied, the polyester resin (A) and the vinyl resin (B) have better miscibility with each other, providing a sufficient fixing region. The relation (1) can be satisfied by bringing the SP value of the polyester resin (A) and the SP value of the vinyl resin (B) close to each other. Particularly, the weight ratio of the monomers (m) and (n) used in the vinyl resin (B) needs to be taken into account. Specifically, the weight ratio of the monomer (m) (such as acrylonitrile (SP value: 14.4) or acrylic acid (SP value: 14.0)) having a higher SP value than the polyester resin (A) and the monomer (n) (such as styrene (SP value: 10.6), butyl acrylate (SP value: 9.8), or ethyl acrylate (SP value: 10.2)) having a lower SP value than the polyester resin (A) is taken into account.

In view of fixability and storage stability, the glass transition temperature (Tg) of the vinyl resin (B) is preferably 35° C. to 75° C., more preferably 40° C. to 72° C. still more preferably 45° C. to 70° C., particularly preferably 50° C. to 68° C.

In view of storage stability and grindability, the acid value of the vinyl resin (B) is preferably less than 8 mg KOH/g, more preferably less than 3 mg KOH/g, still more preferably less than 1 mg KOH/g.

In view of fixability, storage stability, and grindability, the softening point of the vinyl resin (B) is preferably 70° C. to 130° C., more preferably 75° C. to 125° C., still more preferably 80° C. to 120° C., particularly preferably 85° C. to 115° C. The softening point can be measured by the method described in Examples.

In view of heat-resistant storage stability and low-temperature fixability, the glass transition temperature of the toner binder is preferably 40° C. to 90° C., more preferably 45° C. to 85° C., still more preferably 50° C. to 70° C.

In view of hot offset resistance and grindability, the amount of the toner binder insoluble in THF may be 50 wt % or less, preferably 1 to 50 wt %, more preferably 2 to 40 wt %, still more preferably 3 to 30 wt %, particularly preferably 4 to 20 wt %.

The toner binder may contain another binder resin different from the polyester resin (A) and the vinyl resin (B). Examples of the other binder resin include known binder resins such as styrene/(meth)acrylate copolymers, styrene/butadiene copolymers, styrene/(meth)acrylonitrile copolymers, epoxy resin, and polyurethane.

The amount of the other binder resin in the toner binder is preferably 20 wt % or less, more preferably 10 wt % or less, based on the weight of the toner binder.

The toner binder may also contain the crystalline resin (E) as a fixing aid to improve the low-temperature fixability. The crystalline resin (E) may have any chemical structure as long as it is a crystalline resin miscible with the polyester resin (A).

Examples thereof include known resins such as crystalline polyester resin, crystalline polyurethane resin, crystalline polyurea resin, crystalline polyamide resin, and crystalline polyvinyl resin (e.g., crystalline resin and the like described in WO 2015-170705). In view of miscibility, preferred among these are crystalline polyester resin and crystalline polyvinyl resin. In view of crystalline nature, the crystalline polyester resin is preferably one in which the linear aliphatic diol content as a diol component is 80 mol % or more, and the crystalline polyvinyl is preferably one in which the long-chain aliphatic vinyl content is 50 wt % or more.

In view of low-temperature fixability, storage stability, and electrostatic charge stability, the amount of the fixing aid in the toner binder is preferably 20 wt % or less, more preferably 10 wt % or less, based on the weight of the toner binder.

In the present invention, the term "crystalline" means that a DSC curve has a distinct endothermic peak top temperature in differential scanning calorimetry (DSC) described below. In other words, the term "crystalline" refers to properties that result in steep softening by heat, and a resin having such properties is a crystalline resin.

The endothermic peak top temperature of a crystalline resin is measured by the following method.

A differential scanning calorimeter (e.g., DSC210 available from Seiko Instruments Inc.) is used for measurement. A crystalline resin is heated from 20° C. to 150° C. at 10° C./min (first heating); cooled from 150° C. to 0° C. at 10° C./rain; and then heated from 0° C. to 150° C. at 10° C./min (second heating). The endothermic peak top temperature in the second heating process is determined as the endothermic peak top temperature of the crystalline resin.

In the present invention, the term "amorphous" means that a sample shows no endothermic peak top temperature when the transition temperature is measured using a differential scanning calorimeter.

In view of low-temperature fixability and storage stability, the weight average molecular weight of the crystalline resin (E) is preferably 8,000 to 50,000, more preferably 10,000 to 40,000, particularly preferably 12,000 to 38,000.

In view of storage stability, the acid value of the crystalline resin (E) is preferably 5 mg KOH/g or less, more preferably 3 mg KOH/g or less, still more preferably 1 mg KOH/g or less.

In view of low-temperature fixability and storage stability, the endothermic peak top temperature of the crystalline resin (E) is preferably 60° C. to 80° C., more preferably 63° C. to 77° C., still more preferably 65° C. to 75° C.

The toner of the present invention contains the toner binder of the present invention and a colorant.

The toner binder of the present invention is mixed with a colorant and, if necessary, various additives such as a release agent, a charge control agent, and a fluidizer, and is thus used as a toner. The amount of the toner binder of the present invention in the toner is preferably 60 to 98 wt % when a dye or a pigment is used as the colorant, and is preferably 25 to 80 wt % when a magnetic powder is used.

Any dyes and pigments used as coloring agents for toners may be used as the colorant. Specific examples thereof include carbon black, iron black, Sudan black SM, Fast Yellow G, Benzidine Yellow, Pigment Yellow, Indo Fast Orange, Irgazin Red, Paranitroaniline Red, Toluidine Red, Carmine FB, Pigment Orange R, Lake Red 2G, Rhodamine FB, Rhodamine B Lake, Methylviolet B Lake, Phthalocyanine Blue, Pigment Blue, Brilliant Green, Phthalocyanine Green, Oil Yellow GG, Kayaset YG, Orasol Brown B, and Oil Pink OP. These colorants may be used alone or in combination of two or more thereof. If necessary, magnetic powder (powder of a ferromagnetic metal such as iron, cobalt, or nickel, or a compound such as magnetite, hematite, or ferrite) may be added to also serve as a colorant.

The amount of the colorant is preferably 1 to 40 parts by weight, more preferably 2 to 15 parts by weight, relative to 100 parts by weight of the toner binder of the present invention. The amount of the magnetic powder, if used, is preferably 20 to 150 parts by weight, more preferably 30 to 120 parts by weight, relative to 100 parts by weight of the toner binder.

Preferred as the release agent are those having a softening point of 50° C. to 170° C. as measured by a flow tester, examples of which include polyolefin wax, natural wax, C30-C50 aliphatic alcohols, C30-050 fatty acids, and mixtures of two or more thereof. The amount of the release agent is preferably 0 to 30 wt %, more preferably 0.5 to 20 wt %, still more preferably 1 to 10 wt %, based on the weight of the toner.

Examples of the polyolefin wax includes (co)polymers of olefins (e.g., ethylene, propylene, 1-butene, isobutylene, 1-hexene, 1-dodecene, 1-octadecene, and mixtures of two or more thereof) (including those obtained by (co)polymerization and thermo-degradation type polyolefins); oxides with oxygen and/or ozone of (co)polymers of olefins; maleic acid-modified products of (co)polymers of olefins (e.g., those modified by maleic acid and derivatives thereof (e.g., maleic anhydride, monomethyl maleate, monobutyl maleate, and dimethyl maleate)); copolymers of olefins and unsaturated carboxylic acids (such as (meth)acrylic acid, itaconic acid, and maleic anhydride) and/or unsaturated carboxylic acid alkyl esters (such as (meth)acrylic acid alkyl (C1-C18 alkyl group) esters, and maleic acid alkyl (C1-C18 alkyl group) esters); and Sasol wax.

Examples of the natural waxes include carnauba wax, montan wax, paraffin wax, and rice wax. Examples of C30-C50 aliphatic alcohols include triacontanol. Examples of C30-050 fatty acids include triacontane carboxylic acid.

Examples of the charge control agent include nigrosine dyes, triphenylmethane dyes containing a tertiary amine as a side chain, quaternary ammonium salts, polyamine resins, imidazole derivatives, quaternary ammonium salt group-containing polymers, metal-containing azo dyes, copper phthalocyanine dyes, salicylic acid metal salts, boron complexes of benzilic acid, sulfonic acid group-containing polymers, fluorine-containing polymers, and halogen-substituted aromatic ring-containing polymers. The amount of the charge control agent may be 0 to 20 wt %, preferably 0.1 to 10 wt %, more preferably 0.5 to 7.5 wt %, based on the weight of the toner.

Examples of the fluidizer include colloidal silica, alumina powder, titanium oxide powder, and calcium carbonate powder. The amount of the fluidizer may be 0 to 10 wt %, preferably 0 to 5 wt %, more preferably 0.1 to 4 wt %, based on the weight of the toner.

The total weight of the additives may be 3 to 70 wt %, preferably 4 to 58 wt %, more preferably 5 to 50 wt %, based on the weight of the toner. A toner having good electrostatic charging properties can be readily obtained when the proportions of the components of the toner are within the above ranges.

The toner of the present invention may be obtained by any known method such as a kneading grinding method, a phase-change emulsion method, or a polymerization method.

For example, in the case where a toner is obtained by a kneading grinding method, the toner can be produced as follows: components (other than a fluidizer) that constitute the toner are dry-blended by a device such as a Henschel mixer, a Nauta mixer, or a Banbury mixer; melt-kneaded by a continuous mixer such as an extruder, a continuous kneader, or a three-roll mill; coarsely ground by a mill or the like; and ultimately formed into fine particles by a jet mill grinder or the like. Further, the particle size distribution is adjusted by a classifier such as an elbow jet to obtain fine particles preferably having a volume average particle size (D50) in the range of 4 to 12 μm, followed by mixing with a fluidizer by a mill or the like.

The volume average particle size (D50) is measured using a Coulter counter (e.g., product name "Multisizer III" available from Beckman Coulter, Inc.).

The toner of the present invention can be used as a developer for electric latent images. The toner of the present invention may be mixed with carrier particles such as iron powder, glass beads, nickel powders, ferrite, magnetite, and ferrite whose surface is coated with resin (e.g., acrylic resin or silicone resin). The weight ratio of the toner to the carrier particles is preferably 1/99 to 100/0. It is also possible to form electric latent images by friction with a member such as an electrostatically charged blade instead of mixing with the carrier particles.

The toner of the present invention containing the toner binder of the present invention can be used in processes such as electrographic printing, electrostatic recording, and electrostatic printing. More specifically, the toner of the present invention is fixed to a support (e.g., paper or polyester film) by a device such as a copy machine or a printer, whereby a recording material is obtained. The toner can be fixed on a support by a known method such as a heat roll fixing method or a flash fixing method.

EXAMPLES

The present invention is further described below with reference to examples and comparative examples, but the present invention is not limited thereto.

The weight average molecular weight was measured by dissolving a resin in tetrahydrofuran (THF) to obtain a sample solution, and subjecting the sample solution to gel permeation chromatography (GPC) under the following conditions.

Device: HLC-8120 available from Tosoh Corporation
Column: TSK GEL GMH6, two columns (Tosoh Corporation)
Measurement temperature: 40° C.
Sample solution: 0.25% by weight solution in THF
Amount of solution to be injected: 100 μL
Detection device: refractive index detector
Standard substance: standard polystyrene available from Tosoh Corporation (TSK standard polystyrene), 12 samples (molecular weight: 500, 1050, 2800, 5970, 9100, 18100, 37900, 96400, 190000, 355000, 1090000, and 2890000)

The glass transition temperature was measured using a differential scanning calorimeter (model Q Series Version 2.8.0.394 available from TA Instruments) by the method prescribed in ASTM D3418-82 (DSC method).

The acid value and the hydroxyl value were measured by the methods prescribed in JIS K 0070.

The SP value was calculated by the method disclosed by Robert F. Fedors et al. (Polymer Engineering and Science, February, 1974, Vol. 14, No. 2, pp. 147-154).

The softening point was measured by the following method.

Using a Koka-type flow tester (CFT-500D available from Shimadzu Corporation), a measurement sample (1 g) was extruded from a nozzle having a diameter of 1 mm and a length of 1 mm by application of a load of 1.96 MPa with a plunger while the sample was heated at a temperature increase rate of 6° C./rain. A graph of "plunger descending amount (flow value)" against "temperature" was plotted, and the temperature corresponding to ½ of the maximum plunger descending amount (temperature at which half of the measurement sample has flowed out) on the graph was determined as the softening point.

Production Example 1 [Production of Linear Polyester Resin (A1-1)]

A reaction vessel was charged with 325 parts by weight of an adduct of 2 mol ethylene oxide with bisphenol A, 416 parts by weight of an adduct of 2 mol propylene oxide with bisphenol A, 270 parts by weight of terephthalic acid, and 2.5 parts by weight of titanium diisopropoxy bis(triethanolaminate) as a condensation catalyst. They were reacted at 220° C. for 10 hours under reduced pressure of 0.5 to 2.5 kPa while generated water was removed. When the acid value reached 1 mg KOH/g or lower, the reaction product was cooled to 180° C. The reaction product was then reacted with 44 parts by weight of trimellitic anhydride for one hour. The reaction product was cooled to 150° C., and a linear polyester resin (A1-1) was obtained using a steel belt cooler.

Production Example 2 [Production of Linear Polyester Resin (A1-2)]

A reaction vessel was charged with 610 parts by weight of an adduct of 2 mol propylene oxide with a bisphenol A, 167 parts by weight of an adduct of 3 mol propylene oxide with bisphenol A, 268 parts by weight of terephthalic acid, 1 part by weight of fumaric acid, and 2.5 parts by weight of titanium diisopropoxy bis(triethanolaminate) as a condensation catalyst. They were reacted at 220° C. for 10 hours under reduced pressure of 0.5 to 2.5 kPa while generated water was removed. When the acid value reached 1 mg KOH/g or lower, the reaction product was cooled to 180° C. The reaction product was then reacted with 10 parts by weight of trimellitic anhydride for one hour. The reaction product was cooled to 150° C., and a linear polyester resin (A1-2) was obtained using a steel belt cooler.

Production Example 3 [Production of Non-Linear Polyester Resin (A2-1)]

A reaction vessel was charged with 165 parts by weight of an adduct of 2 mol ethylene oxide with bisphenol A, 130 parts by weight of an adduct of 2 mol propylene oxide with bisphenol A, 473 parts by weight of an adduct of 3 mol propylene oxide with bisphenol A, 184 parts by weight of terephthalic acid, 1 part by weight of fumaric acid, and 2.5 parts by weight of titanium diisopropoxy bis(triethanolaminate) as a condensation catalyst. They were reacted at 220° C. for 10 hours under reduced pressure of 0.5 to 2.5 kPa while generated water was removed. When the acid value reached 2 mg KOH/g or lower, the reaction product was reacted with 53 parts by weight of trimellitic anhydride for one hour. The reaction was further continued at 220° C. under reduced pressure of 0.5 to 2.5 kPa. When the acid value reached 3 mg KOH/g or lower, the reaction product was reacted with 52 parts by weight of trimellitic anhydride for one hour. The reaction was further continued at a reduced pressure of 0.5 to 2.5 kPa. When the softening point (Tm) reached 135° C., a non-linear polyester resin (A2-1) was obtained using a steel belt cooler.

Production Example 4 [Production of Non-Linear Polyester Resin (A2-2)]

A reaction vessel was charged with 195 parts by weight of an adduct of 2 mol propylene oxide with bisphenol A, 537 parts by weight of an adduct of 3 mol propylene oxide with bisphenol A, 180 parts by weight of terephthalic acid, 60 parts by weight of adipic acid, 6 parts by weight of trimellitic anhydride, and 2.5 parts by weight of titanium diisopropoxy bis(triethanolaminate) as a condensation catalyst. They were reacted at 220° C. for 10 hours under reduced pressure of 0.5 to 2.5 kPa while generated water was removed. When the acid value reached 1 mg KOH/g or lower, the reaction product was cooled to 180° C. The reaction product was then reacted with 81 parts by weight of trimellitic anhydride for one hour. The temperature was raised to 200° C., and the reaction was further continued under reduced pressure of 0.5 to 2.5 kPa. When the softening point (Tm) reached 130° C., a non-linear polyester resin (A2-2) was obtained using a steel belt cooler.

Production Example 5 [Production of Non-Linear Polyester Resin (A2-3)]

A reaction vessel was charged with 583 parts by weight of 1,2-propylene glycol, 48 parts by weight of an adduct of 2 mol propylene oxide with bisphenol A, 630 parts by weight of terephthalic acid, 8 parts by weight of adipic acid, 45 parts by weight of benzoic acid, 58 parts by weight of trimellitic anhydride, and 2.5 parts by weight of titanium diisopropoxy bis(triethanolaminate) as a condensation catalyst. They were reacted at 220° C. for 20 hours under increased pressure while generated water was removed. Subsequently, the pressure was gradually decreased to normal pressure, and the reaction was further continued at a reduced pressure of 0.5 to 2.5 kPa. When the acid value reached 1 mg KOH/g or lower, the reaction product was cooled to 180° C. The reaction product was then reacted with 17 parts by weight of trimellitic anhydride for one hour. The reaction product was cooled to 150° C., and a non-linear polyester resin (A2-3) was obtained using a steel belt cooler. The amount of 1,2-propylene glycol removed was 234 parts by weight.

Production Example 6 [Production of Non-Linear Polyester Resin (A2-4)]

A reaction vessel was charged with 649 parts by weight of 1,2-propylene glycol, 1 part by weight of an adduct of 2 mol ethylene oxide with bisphenol A, 1 part by weight of an adduct of 2 mol propylene oxide with bisphenol A, 680 parts by weight of terephthalic acid, 25 parts by weight of adipic acid, 34 parts by weight of benzoic acid, 52 parts by weight of trimellitic anhydride, and 2.5 parts by weight of titanium diisopropoxy bis(triethanolaminate) as a condensation catalyst. They were reacted at 220° C. for 10 hours under increased pressure while generated water was removed. Subsequently, the pressure was gradually decreased to normal pressure, and the reaction was further continued at a reduced pressure of 0.5 to 2.5 kPa. When the acid value reached 2 mg KOH/g or lower, a non-linear polyester resin (A2-4) was obtained using a steel belt cooler. The amount of propylene glycol removed was 275 parts by weight.

Table 1 shows compositions and physical properties of the linear polyester resins (A1) and the non-linear polyester resins (A2) obtained in Production Examples 1 to 6.

TABLE 1

| | | | Production Example 1 (A1-1) | Production Example 2 (A1-2) | Production Example 3 (A2-1) | Production Example 4 (A2-2) | Production Example 5 (A2-3) | Production Example 6 (A2-4) |
|---|---|---|---|---|---|---|---|---|
| Composition (parts by weight) | Alcohol component (x) | 1, 2-Propylene glycol | 0 | 0 | 0 | 0 | 349 | 374 |
| | | Bisphenol A-ethylene oxide adduct (2 mol) | 325 | 0 | 165 | 0 | 0 | 1 |
| | | Bisphenol A-propylene oxide adduct (2 mol) | 416 | 610 | 130 | 195 | 48 | 1 |
| | | Bisphenol A-propylene oxide adduct (3 mol) | 0 | 167 | 473 | 537 | 0 | 0 |
| | Carboxylic acid component (y) | Terephthalic acid | 270 | 268 | 184 | 180 | 630 | 680 |
| | | Adipic acid | 0 | 0 | 0 | 60 | 8 | 25 |
| | | Fumaric acid | 0 | 1 | 1 | 0 | 0 | 0 |
| | | Trimellitic anhydride | 44 | 10 | 105 | 87 | 75 | 52 |
| | | Benzoic acid | 0 | 0 | 0 | 0 | 45 | 34 |
| Physical properties | Glass transition temperature (° C.) | | 64 | 56 | 61 | 60 | 63 | 65 |
| | Weight average molecular weight | | 6,000 | 4,900 | 21,000 | 180,000 | 14,000 | 67,000 |
| | THF-insoluble content (wt %) | | 0 | 0 | 38 | 5 | 0 | 1 |
| | Acid value (mg KOH/g) | | 23 | 5 | 22 | 23 | 10 | 2 |
| | Hydroxyl value (mg KOH/g) | | 47 | 60 | 35 | 1 | 25 | 24 |
| | Solubility parameter $(cal/cm^3)^{1/2}$ | | 11.5 | 11.2 | 11.0 | 10.8 | 11.9 | 11.9 |

Production Example 7 [Production of Vinyl Resin (B-1)]

A reaction vessel was charged with 480 parts by weight of xylene, and heated to 170° C. Another vessel was charged with 850 parts by weight of styrene (SP value: 10.6), 50 parts by weight of butyl acrylate (SP value: 9.8), 100 parts by weight of acrylonitrile (SP value: 14.4), 106 parts by weight of xylene, and 40 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-1) was thus obtained.

Production Example 8 [Production of Vinyl Resin (B-2)]

A reaction vessel was charged with 480 parts by weight of xylene, and heated to 170° C. Another vessel was charged with 841 parts by weight of styrene (SP value: 10.6), 120 parts by weight of butyl acrylate (SP value: 9.8), 39 parts by weight of acrylonitrile (SP value: 14.4), 106 parts by weight of xylene, and 40 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-2) was thus obtained.

Production Example 9 [Production of Vinyl Resin (B-3)]

A reaction vessel was charged with 500 parts by weight of xylene, and heated to 190° C. Another vessel was charged with 961 parts by weight of styrene (SP value: 10.6), 20 parts by weight of butyl acrylate (SP value: 9.8), 19 parts by weight of acrylonitrile (SP value: 14.4), 190 parts by weight of xylene, and 30 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-3) was thus obtained.

Production Example 10 [Production of Vinyl Resin (B-4)]

A reaction vessel was charged with 480 parts by weight of xylene, and heated to 170° C. Another vessel was charged with 910 parts by weight of styrene (SP value: 10.6), 15 parts by weight of acrylonitrile (SP value: 14.4), 75 parts by weight of stearyl methacrylate (SP value: 8.9), and 35 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-4) was thus obtained.

Production Example 11 [Production of Vinyl Resin (B-5)]

A reaction vessel was charged with 480 parts by weight of xylene, and heated to 170° C. Another vessel was charged with 880 parts by weight of styrene (SP value: 10.6), 20 parts by weight of butyl acrylate (SP value: 9.8), 95 parts by weight of acrylonitrile (SP value: 14.4), 5 parts by weight of trimethylolpropane triacrylate (SP value: 11.9), and 15 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-5) was thus obtained.

Production Example 12 [Production of Vinyl Resin (B-6)]

A reaction vessel was charged with 480 parts by weight of xylene, and heated to 170° C. Another vessel was charged with 780 parts by weight of styrene (SP value: 10.6), 210 parts by weight of methyl methacrylate (SP value: 9.9), 10 parts by weight of acrylic acid (SP value: 14.0), and 7 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-6) was thus obtained.

Production Example 13 [Production of Vinyl Resin (B-7)]

A reaction vessel was charged with 480 parts by weight of xylene, and heated to 170° C. Another vessel was charged with 600 parts by weight of styrene (SP value: 10.6), 100 parts by weight of vinyl chloride (SP value: 11.0), 297 parts by weight of acrylonitrile (SP value: 14.4), 3 parts by weight of fumaric acid (SP value: 16.4), and 10 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-7) was thus obtained.

Production Example 14 [Production of Vinyl Resin (B-8)]

A reaction vessel was charged with 480 parts by weight of xylene, and heated to 170° C. Another vessel was charged with 590 parts by weight of styrene (SP value: 10.6), 100 parts by weight of methyl methacrylate (SP value: 9.9), 300 parts by weight of 2-ethylhexyl acrylate (SP value: 9.2), 10 parts by weight of acrylonitrile (SP value: 14.4), and 6 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-8) was thus obtained.

Production Example 15 [Production of Vinyl Resin (B-9)]

A reaction vessel was charged with 90 parts by weight of low molecular weight polyethylene (Sunwax 151-P available from Sanyo Chemical Industries, Ltd.) and 480 parts by weight of xylene, and heated to 170° C. Another vessel was charged with 800 parts by weight of styrene (SP value: 10.6), 100 parts by weight of butyl acrylate (SP value: 9.8), 10 parts by weight of acrylonitrile (SP value: 14.4), and 4 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B-9) was thus obtained. Sunwax 151-P is polyethylene having a degree of polymerization of 71.

Comparative Production Example 1 [Production of Vinyl Resin (B'-1)]

A reaction vessel was charged with 100 parts by weight of low molecular weight polyethylene (Sunwax 151-P available from Sanyo Chemical Industries, Ltd.) and 480 parts by weight of xylene, and heated to 170° C. Another vessel was charged with 765 parts by weight of styrene (SP value: 10.6), 45 parts by weight of butyl acrylate (SP value: 9.8), 90 parts by weight of acrylonitrile (SP value: 14.4), 106 parts by weight of xylene, and 37 parts by weight of di-t-butyl peroxide. The mixture was added dropwise to the reaction vessel over 3 hours. The drop line was washed with 14 parts by weight of xylene, and the reaction product was aged at 170° C. for one hour. When the polymerization rate reached 99% or higher, the pressure was reduced, and xylene was removed from the reaction vessel. A vinyl resin (B'-1) was thus obtained.

Comparative Production Example 2 [Production of Vinyl Resin (B'-2)]

A reaction vessel was charged with 500 parts by weight of xylene, and heated to 190° C. Another vessel was charged with 850 parts by weight of styrene (SP value: 10.6), 50 parts by weight of butyl acrylate (SP value: 9.8), 100 parts by weight of acrylonitrile (SP value: 14.4), 106 parts by weight of xylene, and 38 parts by weight of di-t-butyl peroxide. The mixture was added dropwise to the reaction vessel over 3 hours. The drop line was washed with 14 parts by weight of xylene, and the reaction product was aged at 190° C. for 30 minutes. When the polymerization rate reached 99% or higher, the pressure was reduced, and xylene was removed from the reaction vessel. A vinyl resin (B'-2) was thus obtained.

Comparative Production Example 3 [Production of Vinyl Resin (B'-3)]

A reaction vessel was charged with 200 parts by weight of xylene, and heated to 150° C. Another vessel was charged with 850 parts by weight of styrene (SP value: 10.6), 50 parts by weight of butyl acrylate (SP value: 9.8), 100 parts by weight of acrylonitrile (SP value: 14.4), 106 parts by weight of xylene, and 5 parts by weight of di-t-butyl peroxide. The mixture was added dropwise to the reaction vessel over 3 hours. The drop line was washed with 14 parts by weight of xylene, and the reaction product was aged at 150° C. for 60 minutes. Further, the temperature was raised to 170° C., and the reaction product was aged for 60 minutes. When the polymerization rate reached 99% or higher, the pressure was reduced, and xylene was removed from the reaction vessel. A vinyl resin (B'-3) was thus obtained.

Comparative Production Example 4 [Production of Vinyl Resin (B'-4)]

A reaction vessel was charged with 480 parts by weight of xylene, and heated to 170° C. Another vessel was charged with 940 parts by weight of styrene (SP value: 10.6), 60 parts by weight of stearyl methacrylate (SP value: 8.9), and 35 parts by weight of di-t-butyl peroxide. The mixture was added dropwise to the reaction vessel over 3 hours. The drop line was washed with 14 parts by weight of xylene, and the reaction product was aged at 170° C. for 30 minutes. When the polymerization rate reached 99% or higher, the pressure was reduced, and xylene was removed from the reaction vessel. A vinyl resin (B'-4) was thus obtained.

Table 2 shows compositions and physical properties of the vinyl resins (B) and the vinyl resins (B') obtained in Production Examples 7 to 15 and Comparative Production Examples 1 to 4.

TABLE 2

| | | | Production Example 7 (B-1) | Production Example 8 (B-2) | Production Example 9 (B-3) | Production Example 10 (B-4) | Production Example 11 (B-5) | Production Example 12 (B-6) | Production Example 13 (B-7) |
|---|---|---|---|---|---|---|---|---|---|
| Composition (parts by weight) | Monomer (m) | Acrylonitrile | 100 | 39 | 19 | 15 | 95 | 0 | 297 |
| | | Timethylolpropane triacrylate | 0 | 0 | 0 | 5 | 0 | 0 | 0 |
| | | Acrylic acid | 0 | 0 | 0 | 0 | 0 | 10 | 0 |
| | | Fumaric acid | 0 | 0 | 0 | 0 | 0 | 0 | 3 |
| | Monomer (n) | Styrene | 850 | 841 | 961 | 910 | 880 | 780 | 600 |
| | | Butyl acrylate | 50 | 120 | 20 | 0 | 20 | 0 | 0 |
| | | Stearyl methacrylate | 0 | 0 | 0 | 75 | 0 | 0 | 0 |
| | | Methyl methacrylate | 0 | 0 | 0 | 0 | 0 | 210 | 0 |
| | | Vinyl chloride | 0 | 0 | 0 | 0 | 0 | 0 | 100 |
| | | 2-Ethylhexyl acrylate | 0 | 0 | 0 | 0 | 0 | 0 | 0 |
| | Polyolefin resin (C) | Polyethylene | 0 | 0 | 0 | 0 | 0 | 0 | 0 |
| | Radical Reaction initiator (d) | di-t-Butyl peroxide | 40 | 40 | 30 | 35 | 15 | 7 | 10 |
| Physical properties | Glass transition temperature (° C.) | | 64 | 54 | 61 | 57 | 75 | 64 | 60 |
| | Weight average molecular weight | | 5,000 | 4,800 | 4,000 | 5,700 | 40,000 | 6,500 | 6,000 |
| | Acid value (mg KOH/g) | | 0 | 0 | 0 | 0 | 0 | 7.8 | 2.9 |
| | Softening point (° C.) | | 109 | 99 | 108 | 110 | 130 | 115 | 110 |
| | Solubility parameter $(cal/cm^3)^{1/2}$ | | 10.9 | 10.6 | 10.6 | 10.5 | 10.9 | 10.5 | 11.8 |

TABLE 2-continued

| | | | Production Example 14 (B-8) | Production Example 15 (B-9) | Comparative Production Example 1 (B'-1) | Comparative Production Example 2 (B'-2) | Comparative Production Example 3 (B'-3) | Comparative Production Example 4 (B'-4) |
|---|---|---|---|---|---|---|---|---|
| Composition (parts by weight) | Monomer (m) | Acrylonitrile | 10 | 10 | 90 | 100 | 100 | 0 |
| | | Timethylolpropane triacrylate | 0 | 0 | 0 | 0 | 0 | 0 |
| | | Acrylic acid | 0 | 0 | 0 | 0 | 0 | 0 |
| | | Fumaric acid | 0 | 0 | 0 | 0 | 0 | 0 |
| | Monomer (n) | Styrene | 590 | 800 | 765 | 850 | 850 | 940 |
| | | Butyl acrylate | 0 | 100 | 45 | 50 | 50 | 0 |
| | | Stearyl methacrylate | 0 | 0 | 0 | 0 | 0 | 60 |
| | | Methyl methacrylate | 100 | 0 | 0 | 0 | 0 | 0 |
| | | Vinyl chloride | 0 | 0 | 0 | 0 | 0 | 0 |
| | | 2-Ethylhexyl acrylate | 300 | 0 | 0 | 0 | 0 | 0 |
| | Polyolefin resin (C) | Polyethylene | 0 | 90 | 100 | 0 | 0 | 0 |
| | Radical Reaction initiator (d) | di-t-Butyl peroxide | 6 | 4 | 37 | 38 | 5 | 35 |
| Physical properties | Glass transition temperature (° C.) | | 35 | 65 | 65 | 55 | 70 | 58 |
| | Weight average molecular weight | | 9,000 | 13,000 | 16,500 | 3,500 | 45,000 | 5,500 |
| | Acid value (mg KOH/g) | | 0 | 0 | 0 | 0 | 0 | 0 |
| | Softening point (° C.) | | 75 | 118 | 114 | 97 | 125 | 110 |
| | Solubility parameter $(cal/cm^3)^{1/2}$ | | 10.1 | 10.3 | 10.7 | 10.9 | 10.9 | 10.5 |

The linear polyester resin (A1-1) and the non-linear polyester resin (A2-1) obtained above were homogenized by a Henschel mixer (FM10B available from Nippon Coke & Engineering Co. Ltd.) to obtain a weight ratio (A1-1)/(A2-1) of 50/50. A polyester resin (A-1) was thus obtained. The polyester resin (A-1) had an acid value of 23 mg KOH/g.

Similarly, a polyester resin (A-2) was obtained from the linear polyester resin (A1-2) and the non-linear polyester resin (A2-2) at a weight ratio (A1-2)/(A2-2) of 70/30, and a polyester resin (A-3) was obtained from the non-linear polyester resins (A2-3) and (A2-4) at a weight ratio (A2-3)/(A2-4) of 50/50. The polyester resin (A-2) had an acid value of 10 mg KOH/g, and the polyester resin (A-3) had an acid value of 6 mg KOH/g.

Production Example 16 [Production of Crystalline Resin (E-1)]

A reaction vessel equipped with a condenser, a stirrer, and a nitrogen inlet was charged with 714 parts by weight of dodecanedioic acid, 373 parts by weight of 1,6-hexanediol, 22 parts by weight of behenyl alcohol, and 0.5 parts by weight of tetrabutoxy titanate as a condensation catalyst. The mixture was reacted at 170° C. for eight hours under a nitrogen stream while generated water was removed. Then, the reaction was continued for additional four hours under a nitrogen stream while generated water was removed, as the temperature was gradually increased up to 220° C. The reaction was further continued under reduced pressure of 0.5 to 2.5 kPa, and the reaction product was taken out when the acid value reached 1 mg KOH/g or less. The resin taken out was cooled to room temperature and ground into particles. A crystalline resin (E-1) was thus obtained. The crystalline resin (E-1) had a weight average molecular weight of 37,000, an acid value of 1 mg KOH/g, and an endothermic peak top temperature of 74° C.

Production Example 17 [Production of Crystalline Resin (E-2)]

A reaction vessel equipped with a condenser, a stirrer, and a nitrogen inlet was charged with 677 parts by weight of sebacic acid, 422 parts by weight of 1,6-hexanediol, 22 parts by weight of behenic acid, and 0.5 parts by weight of tetrabutoxy titanate as a condensation catalyst. The mixture was reacted at 170° C. for eight hours under a nitrogen stream while generated water was removed. Then, the reaction was continued for additional four hours under a nitrogen stream while generated water was removed, as the temperature was gradually increased up to 220° C. The reaction was further continued under reduced pressure of 0.5 to 2.5 kPa, and the reaction product was taken out when the acid value reached 1 mg KOH/g or less. The resin taken out was cooled to room temperature and ground into particles. A crystalline resin (E-2) was thus obtained. The crystalline resin (E-2) had a weight average molecular weight of 19,000, an acid value of 1 mg KOH/g, and an endothermic peak top temperature of 68° C.

Examples 1 to 16 and Comparative Examples 1 to 5

Using the polyester resins (A), the vinyl resins (B), the crystalline resins (E), and the vinyl resins (B') obtained in the production examples and the comparative production examples, toner materials each containing a toner binder and additives in amounts (parts by weight) shown in Tables 3 and 4 were made into toners (T-1) to (T-16) and (T'-1) to (T'-5) by the following method.

The colorant was carbon black (MA-100 available from Mitsubishi Chemical Corporation), the release agent was carnauba wax (refined carnauba wax available from Nippon Wax Co., Ltd.), the charge control agent was Eisen Spiron Black (T-77 available from Hodogaya Chemical Co., Ltd.), and the fluidizer was colloidal silica (Aerosil R972 available from Nippon Aerosil Co., Ltd.).

First, the colorant, the release agent, and the charge control agent were added to the polyester resin (A), the vinyl resin (B), and the vinyl resin (B') shown in Tables 3 and 4, and they were pre-mixed by a Henschel mixer (FM10B available from Nippon Coke & Engineering Co. Ltd.), and then kneaded by a twin-screw kneader (PCM-30 available from Ikegai Corporation). Subsequently, after the kneaded mixture was finely pulverized with an airflow pulverizer (KJ-25 available from Kurimoto, Ltd.), the resultant particles were classified by Elbow-Jet Air Classifier (available from MATSUBO Corporation, EJ-L-3 (LABO) model) to obtain toner particles having a volume average particle size D50 of 6.5 μm. Subsequently, a fluidizer was added to the toner particles in a sample mill. Thus, a toner containing a toner binder, a colorant, a release agent, a charge control agent, and a fluidizer was obtained. The number average dispersed particle size of the vinyl resin (B) in the toner binder was measured by the following measurement method, using the toner obtained.

The amount of the THF-insoluble content of the polyester resin (A) and the amount of the THF-insoluble content of the toner binder were determined by the following method.

An amount of 50 mL of THF was added to 0.5 g of a sample, and the mixture was refluxed under stirring for three hours. After cooling, the insoluble content was separated by filtration with a glass filter, and the resin remaining on the glass filter was dried at 80° C. under reduced pressure for three hours. The amount of insoluble content was calculated from a ratio of the weight of the dried resin remaining on the glass filter to the weight of the sample.

The number average dispersed particle size of the vinyl resin (B) in the toner binder was determined by the following method.

The toners obtained in the examples and the comparative examples were made into very thin pieces (about 100 μm), and the vinyl resin (B) was stained with ruthenium tetroxide. Subsequently, the pieces were observed under a transmission electron microscope (TEM) at a magnification of 10,000 times, and the particle size of the vinyl resin (B) in the toner (toner binder) was calculated by image analysis, using an image processing device.

The volume average particle size (D50) (μm), number average particle size (μm), and particle size distribution (volume average particle size/number average particle size) of the toner particles (T) were measured using a Coulter counter (product name "Multisizer III" available from Beckman Coulter, Inc.).

First, 0.1 to 5 mL of a surfactant (alkylbenzene sulfonate) as a dispersant was added to 100 to 150 mL of an electrolytic aqueous solution "ISOTON-II" (Beckman Coulter, Inc.). Further, 2 to 20 mg of a measurement sample was added and suspended in the electrolyte solution. The electrolyte solution was subjected to a dispersion treatment for about one to three minutes using an ultrasonic disperser. Using the measurement device with an aperture size of 50 μm, the volume and the number of the toner particles were measured, and the volume distribution and the number distribution were calculated. The volume average particle size (D50) (μm), number average particle size (μm), and particle size distribution (volume average particle size/number average particle size) of the toner particles were determined from the resulting distribution.

[Evaluation Methods]

The following describes measurement method, evaluation methods, and criteria for testing each of the toners for low-temperature fixability, hot offset resistance, storage stability, electrostatic charge stability, and grindability.

<Low-Temperature Fixability>

The toner was uniformly placed on paper to a weight per unit area of 0.6 mg/cm$^2$. Here, the powder was placed on the paper using a printer with a thermal fixing device removed. Any other method may be used as long as the powder can be uniformly placed at the above weight density.

The low-temperature fixing temperature, i.e., the cold offset occurrence temperature, of the toner was measured by passing the paper between a pressure roller and a heating roller at a fixing rate (peripheral speed of the heating roller) of 213 mm/sec and a fixing pressure (the pressure roller pressure) of 10 kg/cm$^2$.

The lower the low-temperature fixing temperature, the better the low-temperature fixability. The low-temperature fixing temperature of the toner was regarded as low-temperature fixability (° C.).

<Hot Offset Resistance (Hot Offset Occurrence Temperature)>

The fixability was evaluated as in the low-temperature fixability, and the fixed image was visually observed for occurrence of hot offset.

The hot offset occurrence temperature after the paper passed the pressure roller was regarded as hot offset resistance (° C.).

<Storage Stability>

The toner was left to stand in an atmosphere of 50° C. for 24 hours. The degree of blocking was visually observed, and the heat-resistant storage stability was evaluated according to the following criteria.

[Criteria]

Good: No blocking occurred.

Poor: Blocking occurred.

<Electrostatic Charge Stability>

(1) A 50-mL glass jar was charged with 0.5 g of the toner and 20 g of a ferrite carrier (F-150 available from Powdertech Co., Ltd.). The temperature and the relative humidity inside the glass jar were controlled at 23° C. and 50% for at least eight hours.

(2) The glass jar was friction-stirred at 50 rpm for 10 minutes and for 60 minutes by a Turbula shaker-mixer. The electrostatic charge level was measured for each time period.

A blow-off electrostatic charge level measurement device available from Kyocera Chemical Corporation was used for the measurement.

A value of "electrostatic charge level after a friction time of 60 minutes/electrostatic charge level after a friction time of 10 minutes" was calculated to obtain an index of the electrostatic charge stability.

[Criteria]

Excellent: 0.8 or higher

Good: 0.7 or higher and less than 0.8

Fair: 0.6 or higher and less than 0.7

Poor: less than 0.6

<Grindability>

The toner raw material was kneaded by a twin screw kneader and cooled. The resultant coarse particles (particle size: from a size capable of passing through 8.6 mesh to a size not capable of passing through 30 mesh) were finely ground by a supersonic jet mill (Labojet KJ-25 available from Kurimoto, Ltd.) under the following conditions.

Grinding pressure: 0.64 MPa

Grinding time: 15 min

Separator frequency: 150 Hz

Adjuster ring: 15 mm

Louver size: medium

Without classification, the volume average particle size (μm) of these finely ground particles was measured by a Coulter counter (product name "Multisizer III" available from Beckman Coulter, Inc.) to evaluate the grindability by the following criteria.

[Criteria]

Good: volume average particle size of less than 8 μm

Fair: volume average particle size of 8 μm or more and less than 10 μm

Poor: volume average particle size of 10 μm or more

Table 3 and Table 4 show the evaluation results. "Glass-transition temperature of (A)" and "THF-insoluble content of (A)" in the tables are the glass-transition temperature of the polyester resin (A) and the amount of the THF-insoluble content of the polyester resin (A). "Average dispersed particle size of (B)" is the number average dispersed particle size of the vinyl resin (B) in the toner binder.

TABLE 3

| | | | | Example 1 (T-1) | Example 2 (T-2) | Example 3 (T-3) | Example 4 (T-4) | Example 5 (T-5) |
|---|---|---|---|---|---|---|---|---|
| Composition (parts by weight) | Toner binder | Polyester resin (A) | (A-1) | 95 | — | — | — | — |
| | | | (A-2) | — | 95 | 95 | 95 | 95 |
| | | | (A-3) | — | — | — | — | — |
| | | Vinyl resin (B) | (B-1) | 5 | 5 | — | — | — |
| | | | (B-2) | — | — | 5 | — | — |
| | | | (B-3) | — | — | — | 5 | — |
| | | | (B-4) | — | — | — | — | 5 |
| | | | (B-5) | — | — | — | — | — |
| | | Colorant | | 8 | 8 | 8 | 8 | 8 |
| | | Release agent | | 4 | 4 | 4 | 4 | 4 |
| | | Charge control agent | | 1 | 1 | 1 | 1 | 1 |
| | | Fluidizer | | 2 | 2 | 2 | 2 | 2 |
| Evaluation of physical properties | | Glass transition temperature of (A) (° C.) | | 62 | 58 | 58 | 58 | 58 |
| | | THF-insoluble content of (A) (%) | | 20 | 2 | 2 | 2 | 2 |
| | | Average dispersed particle size of (B) (μm) | | 0.1 | 0.05 | 0.2 | 0.2 | 0.4 |
| | | \| SP(a)-SP(B) \| | | 0.4 | 0.2 | 0.5 | 0.5 | 0.6 |
| | | Glass transition temperature of toner binder (° C.) | | 62 | 58 | 58 | 58 | 58 |
| | | THF-insoluble content of toner binder (%) | | 20 | 2 | 2 | 2 | 2 |
| | | Volume average particle size of (T) (μm) | | 6.5 | 6.5 | 6.5 | 6.5 | 6.5 |
| | | Particle size distribution of (T) | | 1.2 | 1.2 | 1.2 | 1.2 | 1.2 |
| Results of performance | | Low-temperature fixability (° C.) | | 130 | 125 | 125 | 125 | 125 |
| | | Hot offset resistance (° C.) | | 210 | 190 | 190 | 190 | 190 |
| | | Storage stability | | Good | Good | Good | Good | Good |
| | | Electrostatic charge stability | | Excellent | Excellent | Excellent | Excellent | Good |
| | | Grindability | | Good | Good | Good | Good | Good |

| | | | | Example 6 (T-6) | Example 7 (T-7) | Example 8 (T-8) | Example 9 (T-9) | Example 10 (T-10) |
|---|---|---|---|---|---|---|---|---|
| Composition (parts by weight) | Toner binder | Polyester resin (A) | (A-1) | — | — | — | — | — |
| | | | (A-2) | 80 | 90 | 99.5 | — | — |
| | | | (A-3) | — | — | — | 95 | 95 |
| | | Vinyl resin (B) | (B-1) | 20 | 10 | 0.5 | 5 | — |
| | | | (B-2) | — | — | — | — | — |
| | | | (B-3) | — | — | — | — | — |
| | | | (B-4) | — | — | — | — | — |
| | | | (B-5) | — | — | — | — | 5 |
| | | Colorant | | 8 | 8 | 8 | 8 | 8 |
| | | Release agent | | 4 | 4 | 4 | 4 | 4 |
| | | Charge control agent | | 1 | 1 | 1 | 1 | 1 |
| | | Fluidizer | | 2 | 2 | 2 | 2 | 2 |
| Evaluation of physical properties | | Glass transition temperature of (A) (° C.) | | 58 | 58 | 58 | 64 | 64 |
| | | THF-insoluble content of (A) (%) | | 2 | 2 | 2 | 0 | 0 |
| | | Average dispersed particle size of (B) (μm) | | 0.4 | 0.3 | 0.1 | 1.0 | 1.1 |
| | | \| SP(a)-SP(B) \| | | 0.2 | 0.2 | 0.2 | 1.0 | 1.0 |
| | | Glass transition temperature of toner binder (° C.) | | 59 | 59 | 58 | 64 | 64 |
| | | THF-insoluble content of toner binder (%) | | 2 | 2 | 2 | 0 | 0 |
| | | Volume average particle size of (T) (μm) | | 6.5 | 6.5 | 6.5 | 6.5 | 6.5 |
| | | Particle size distribution of (T) | | 1.2 | 1.2 | 1.2 | 1.2 | 1.2 |
| Results of performance | | Low-temperature fixability (° C.) | | 125 | 125 | 125 | 135 | 135 |
| | | Hot offset resistance (° C.) | | 180 | 185 | 190 | 200 | 200 |
| | | Storage stability | | Good | Good | Good | Good | Good |
| | | Electrostatic charge stability | | Excellent | Excellent | Excellent | Good | Good |
| | | Grindability | | Good | Good | Good | Good | Good |

TABLE 4

| | | | | Example 11 (T-11) | Example 12 (T-12) | Example 13 (T-13) | Example 14 (T-14) | Example 15 (T-15) | Example 16 (T-16) |
|---|---|---|---|---|---|---|---|---|---|
| Composition (parts by weight) | Toner binder | Polyester resin (A) | (A-1) | 95 | — | 95 | — | 90 | — |
| | | | (A-2) | — | 95 | — | — | — | — |
| | | | (A-3) | — | — | — | 95 | — | 85 |
| | | Vinyl resin (B) | (B-1) | — | — | — | — | 5 | — |
| | | | (B-5) | — | — | — | — | — | 5 |
| | | | (B-6) | 5 | — | — | — | — | — |
| | | | (B-7) | — | 5 | — | — | — | — |
| | | | (B-8) | — | — | 5 | — | — | — |
| | | | (B-9) | — | — | — | 5 | — | — |
| | | Vinyl resin (B') | (B'-1) | — | — | — | — | — | — |
| | | | (B'-2) | — | — | — | — | — | — |
| | | | (B'-3) | — | — | — | — | — | — |
| | | | (B'-4) | — | — | — | — | — | — |
| | | Crystalline resin (E) | (E-1) | — | — | — | — | 5 | — |
| | | | (E-2) | — | — | — | — | — | 10 |
| | | Colorant | | 8 | 8 | 8 | 8 | 8 | 8 |
| | | Release Agent | | 4 | 4 | 4 | 4 | 4 | 4 |
| | | Charge Control agent | | 1 | 1 | 1 | 1 | 1 | 1 |
| | | Fluidizer | | 2 | 2 | 2 | 2 | 2 | 2 |
| Evaluation of physical properties | | Glass transition temperature of (A) (° C.) | | 62 | 58 | 62 | 64 | 62 | 64 |
| | | THF-insoluble content of (A) (%) | | 20 | 2 | 20 | 0 | 20 | 0 |
| | | Average dispersed particle size of (B) (μm) | | 0.7 | 0.5 | 1.5 | 1.8 | 0.1 | 1.1 |
| | | \| SP(a)-SP(B) \| | | 0.8 | 0.7 | 1.1 | 1.6 | 0.4 | 1.0 |
| | | Glass transition temperature of toner binder (° C.) | | 62 | 58 | 61 | 64 | 58 | 60 |
| | | THF-insoluble content of toner binder (%) | | 20 | 2 | 20 | 0 | 18 | 0 |
| | | Volume average particle size of (T) (μm) | | 6.5 | 6.5 | 6.5 | 6.5 | 6.5 | 6.5 |
| | | Particle size distribution of (T) | | 1.2 | 1.2 | 1.2 | 1.2 | 1.2 | 1.2 |
| Results of performance | | Low-temperature fixability (° C.) | | 130 | 125 | 130 | 135 | 115 | 110 |
| | | Hot offset resistance (° C.) | | 210 | 190 | 210 | 200 | 195 | 180 |
| | | Storage stability | | Good | Good | Good | Good | Good | Good |
| | | Electrostatic charge stability | | Excellent | Excellent | Good | Good | Good | Good |
| | | Grindability | | Good | Good | Good | Good | Good | Good |

| | | | | Comparative Example 1 (T'-1) | Comparative Example 2 (T'-2) | Comparative Example 3 (T'-3) | Comparative Example 4 (T'-4) | Comparative Example 5 (T'-5) |
|---|---|---|---|---|---|---|---|---|
| Composition (parts by weight) | Toner binder | Polyester resin (A) | (A-1) | — | — | — | — | — |
| | | | (A-2) | 95 | 95 | 95 | 100 | — |
| | | | (A-3) | — | — | — | — | 95 |
| | | Vinyl resin (B) | (B-1) | — | — | — | — | — |
| | | | (B-5) | — | — | — | — | — |
| | | | (B-6) | — | — | — | — | — |
| | | | (B-7) | — | — | — | — | — |
| | | | (B-8) | — | — | — | — | — |
| | | | (B-9) | — | — | — | — | — |
| | | Vinyl resin (B') | (B'-1) | 5 | — | — | — | — |
| | | | (B'-2) | — | 5 | — | — | — |
| | | | (B'-3) | — | — | 5 | — | — |
| | | | (B'-4) | — | — | — | — | 5 |
| | | Crystalline resin (E) | (E-1) | — | — | — | — | — |
| | | | (E-2) | — | — | — | — | — |
| | | Colorant | | 8 | 8 | 8 | 8 | 8 |
| | | Release Agent | | 4 | 4 | 4 | 4 | 4 |
| | | Charge Control agent | | 1 | 1 | 1 | 1 | 1 |
| | | Fluidizer | | 2 | 2 | 2 | 2 | 2 |
| Evaluation of physical properties | | Glass transition temperature of (A) (° C.) | | 58 | 58 | 58 | 58 | 64 |
| | | THF-insoluble content of (A) (%) | | 2 | 2 | 2 | 2 | 0 |
| | | Average dispersed particle size of (B) (μm) | | 0.2 | 0.1 | 0.1 | — | 2.5 |
| | | \| SP(a)-SP(B) \| | | 0.4 | 0.2 | 0.2 | — | 1.5 |
| | | Glass transition temperature of toner binder (° C.) | | 58 | 58 | 58 | 58 | 58 |
| | | THF-insoluble content of toner binder (%) | | 2 | 2 | 2 | 2 | 0 |
| | | Volume average particle size of (T) (μm) | | 6.5 | 6.5 | 6.5 | 6.5 | 6.5 |
| | | Particle size distribution of (T) | | 1.2 | 1.2 | 1.2 | 1.2 | 1.2 |
| Results of performance | | Low-temperature fixability (° C.) | | 125 | 125 | 135 | 125 | 125 |
| | | Hot offset resistance (° C.) | | 190 | 175 | 190 | 190 | 190 |
| | | Storage stability | | Good | Poor | Good | Good | Good |
| | | Electrostatic charge stability | | Good | Fair | Good | Good | Fair |
| | | Grindability | | Fair | Good | Poor | Fair | Good |

As is clear from the evaluation results in Tables 3 and 4, all the toners of Examples 1 to 16 of the present invention received excellent performance evaluations. In contrast, the grindability was poor in Comparative Example 1 in which the total weight percentage of the polyethylene units (C11) having a degree of polymerization of 70 to 210 and the polypropylene units (C12) having a degree of polymerization 70 to 210 in the vinyl resin (B) was more than 9 wt % based on the weight of the vinyl resin (B). The performances such as storage stability and grindability were poor in Comparative Examples 2 and 3 in which the weight average molecular weight of the vinyl resin (B) was less than 4,000 or more than 40,000. The grindability was poor in Comparative Example 4 in which the vinyl resin (B) was absent. The electrostatic charge stability was poor in Comparative Example 5 in which the vinyl resin (B) did not contain the monomer (m).

INDUSTRIAL APPLICABILITY

The toner binder and the toner of the present invention maintain grindability while having high offset resistance, and are excellent in low-temperature fixability, storage stability, and electrostatic charging properties. The toner binder and the toner can be suitably used as a toner and a toner binder for developing full-color electrostatic images in processes such as electrographic printing, electrostatic recording, and electrostatic printing. The toner binder and the toner are also suitably applicable as additives for coating materials, additives for adhesives, and particles for electronic paper.

The invention claimed is:

1. A toner binder comprising:

a polyester resin (A); and a vinyl resin (B), wherein the polyester resin (A) has an acid value of 2 mg KOH/g or more, the vinyl resin (B) has a weight average molecular weight of 4,000 to 40,000, the vinyl resin (B) is a polymer containing a monomer (m) whose homopolymer has an SP value of 11.5 to 16.5 as a constituent monomer, the weight percentage of the monomer (m) in monomers constituting the vinyl resin (B) is 1 wt % or more based on the total weight of the monomers constituting the vinyl resin (B), the polyester resin (A) and the vinyl resin (B) are present at a weight ratio (A)/(B) of 80/20 to 99.5/0.5, and when the vinyl resin (B) contains polyethylene units (C11) having a degree of polymerization of 70 to 210 and/or polypropylene units (C12) having a degree of polymerization of 70 to 210, the total weight percentage of the polyethylene units (C11) and the polypropylene units (C12) in the vinyl resin (B) is 9 wt % or less based on the weight of the vinyl resin (B).

2. The toner binder according to claim 1, wherein the vinyl resin (B) has a solubility parameter of 10.0 to 12.6 $(cal/cm^3)^{1/2}$.

3. The toner binder according to claim 1, wherein the toner binder satisfies the following relation (1):

$$0.1 \leq |SP(a)-SP(b)| \leq 1.4 \quad \text{relation (1):}$$

where SP(a) is the solubility parameter of the polyester resin (A), and SP(b) is the solubility parameter of the vinyl resin (B).

4. The toner binder according to claim 1, wherein the vinyl resin (B) has a glass transition temperature of 35° C. to 75° C.

5. The toner binder according to claim 1, wherein the vinyl resin (B) has a number average dispersed particle size of 0.02 to 2 μm in the toner binder.

6. The toner binder according to claim 1, wherein the vinyl resin (B) has an acid value of less than 8 mg KOH/g.

7. The toner binder according to claim 1, wherein the vinyl resin (B) has a softening point of 70° C. to 130° C.

8. A toner comprising:

the toner binder according to claim 1; and a colorant.

* * * * *